US010329756B2

(12) United States Patent
Li

(10) Patent No.: US 10,329,756 B2
(45) Date of Patent: Jun. 25, 2019

(54) LEAK-PROOF TOILET TANK

(71) Applicant: Wun-Chou Li, Kaohsiung (TW)

(72) Inventor: Wun-Chou Li, Kaohsiung (TW)

( * ) Notice: Subject to any disclaimer, the term of this patent is extended or adjusted under 35 U.S.C. 154(b) by 0 days.

(21) Appl. No.: 15/965,253

(22) Filed: Apr. 27, 2018

(65) Prior Publication Data

US 2018/0320353 A1 Nov. 8, 2018

(30) Foreign Application Priority Data

May 4, 2017 (TW) ..... 106114738 A
Jun. 26, 2017 (TW) ..... 106121217 A

(51) Int. Cl.
*E03D 5/00* (2006.01)
*E03D 5/092* (2006.01)

(52) U.S. Cl.
CPC ..... *E03D 5/092* (2013.01)

(58) Field of Classification Search
CPC ..... E03D 5/092
USPC ..... 4/405
See application file for complete search history.

(56) References Cited

U.S. PATENT DOCUMENTS 2,173,070 A 9/1939 Brown
2,324,084 A 7/1943 Horner
4,631,760 A * 12/1986 Leishman ..... E03D 1/16 4/300
2013/0247291 A1* 9/2013 Bowcutt ..... E03D 11/00 4/405
2015/0074894 A1* 3/2015 Kim ..... E03D 1/308 4/395

FOREIGN PATENT DOCUMENTS

GB 1009743 A 11/1965

* cited by examiner

*Primary Examiner* — Huyen D Le

(74) *Attorney, Agent, or Firm* — Li & Cai Intellectual Property (USA) Office

(57) ABSTRACT

A leak-proof toilet tank, includes a toilet tank, a water-supply valve, a float cup, a float and a sealed drain device; wherein, the float cup has a sealed bottom. When the water supply is filled to the toilet tank, the water level raises up to make the float blocking the water supply. When leaks water leakage, the float cup does not leak water because of the sealed bottom, and the water level is not changed, further maintains the float to the predetermined position. The present disclosure further provides a passway for supplying water to the float cup. Even if water leakage happens, the float can be pushed to block the water supply by filling the water in the sub-tank into the float cup or by supplying water directly by the water supply pipe, so that reaching the effect of leak-proof of the toilet tank.

19 Claims, 13 Drawing Sheets

LEAK-PROOF TOILET TANK

BACKGROUND

1. Technical Field

The instant disclosure relates to a leak-proof tank, and in particular, to a leak-proof toilet tank.

2. Description of Related Art

Referring to FIG. 1A and FIG. 1B, the schematic diagrams of a conventional single-water-supply valve 9A in opening state and a second lifting mechanism 10C are provided; and FIG. 2 is a schematic diagram of a conventional single-water-supply valve 9A in the closed state and a second lifting mechanism 10C. After the water source is input into the toilet tank 1A through the through hole 14 of the single-water-supply valve 9A, the water overflows into the float cup 110*a* because the water level rises over the float cup 110*a*. The float cup bottom surface 112*a* of the float cup 110*a* is provided with a float cup bottom hole 113*a*, a sliding body 1111 of a piston 1110 is slidably disposed on the float cup bottom hole 113*a*, the piston 1110 is provided with a piston disc surface 1113 which is larger than the float cup bottom hole 113*a* and extending with a sliding body 1111 having at least two sliding bodies 1111 which correspond to each other and are provided with barbs at the end. When the water in the toilet tank 1A is sufficient to push the piston disc 1112 up, making the piston disc surface 1113 block the float cup bottom hole 113*a*, the toilet tank 1A is further filled with water and the water level raises up till over the float cup 110*a*, and the float 10 is pushed by the stored water of the float cup 110*a*, so that the float 10 is floated up to the predetermined position to block the water source. When the toilet tank 1A drains out the stored water, the piston disc surface 1113 of the piston disc 1112 opens the float cup bottom hole 113*a* because the water level of the toilet tank 1A falls down, the stored water in the float cup 110*a* loses from the float cup bottom hole 113*a*, so that the water level of the float cup 110*a* falls down, the float 10 falls down responsively, and water supply is restored. When the float 10 accommodated in the float cup 110 is pushed up by the floating, the second lifting mechanism 10C is used in conjunction with the pole 6, coordinating with the single-water-supply valve 9A, to make the deformation end of the packing 4 disposed in the single-water-supply valve 9A expand to block the water supply. When the water level of the toilet tank 1A falls down due to the drain, the stored water in the float cup 110*a* is drained out, and the float 10 falls down as well, the deformation end of the packing 4 recovers, and the water outlet 33 of the filling tube 3 resumes supplying water again. The structure of the prior art is provided herein as an example. The water level of the toilet tank 1A rises over the float cup 110*a*, pushing the float 10 accommodated in the float cup 110*a* up, and the second lifting mechanism 10C is used and coordinates with the single-water-supply valve 9A, making the deformation end of the packing 4 disposed in the single-water-supply valve 9A expand to block the water supply. The stored water in the float cup 110*a* drains when the toilet tank 1A drains, such that the float 10 accommodated in the float cup 110*a* falls down, and the second lifting mechanism 10C is used and coordinates with the single-water-supply valve 9A, making the deformation end of the packing 4 disposed in the single-water-supply valve 9A recover and open the water outlet 33 of the filling tube 3 to supply water. The above-mentioned steps are generally used in the previous technology. However, if the volume of water leakage of the toilet tank 1A is larger than the income volume of the through hole 14, the water level of the toilet tank 1A is unable to push the piston disc 1112 up to make the piston disc surface 1113 block the float cup bottom hole 113*a*. If the water level of the toilet tank 1A cannot exceed the float cup 110*a*, the water leakage cannot be stopped. If the volume of water leakage of the toilet tank 1A is smaller than the income volume of the through hole 14, the water level of the toilet tank 1A may go over the float cup 110*a* to push the float 10 up to the predetermined position to almost block the water supply. However, the water leakage of the toilet tank 1A will cause the water filling into float cup 110*a* unstable, so that the piston disc surface 1113 is unable to block float cup bottom hole 113*a* completely, resulting in that the lever cannot effectively link to the pole 6. Accordingly, the deformation end of the packing 4 of the single-water-supply valve 9A would not able to complete the action of extending to block the water outlet 33 of the filling tube 3 to stop the water supply.

SUMMARY

The present disclosure provides a leak-proof toilet tank to improve the water leakage of the toilet tank, and the float cup in the toilet tank of the present disclosure is provided with a sealed bottom. The through hole of the jacket tube (it is defined as a "through hole of the single-water-supply valve or the double-water-supply valve") supplies water into the toilet tank; when the water level rises above the float cup, the water overflows into the float cup, so that the float contained in the float cup will be pushed up to a predetermined position by the buoyancy force to block the water supply. When the water level of the toilet tank is reduced due to water leakage, the float cup will not leak water by the completely sealed bottom of the float cup, so that the water level of the float cup will not reduce due to the leakage of the toilet tank, further maintaining the float in the predetermined position.

The present disclosure provides a double-water-supply valve, to supply water not only by the through hole of the jacket tube but also a passway from the water supply pipe to the float cup, for delivering water from the water supply pipe through the water tube to a sub-tank disposed upward the float cup, then the water is delivered to the float cup by the pipe in the sub-tank. The double-water-supply valve above-mentioned further provides the other passway to supply water from the water supply pipe to the float cup, for delivering water from the water supply pipe directly to float cup. If the water leakage occurs before the water level rises sufficient to overflow to the float cup, it can be poured into the float cup with the water from the sub-tank or directly from the water supply pipe to push the float up. When the float is pushed up, a screw thread which is screwed with the float will also move upward, and a sleeve ring on the screw thread is fixed on a sleeve hole of the end of the lever, so that the end of the lever moves up, making the abutting surface at the front side of a pivot pin (used as a pivot point) push a abutting side of the pole downward, which is closed, and thus the front side of the pole can block the through hole of the packing, making the deformation end of packing expand to block the water supply by at least the inner portion or the middle portion. That is to say, the float can block the water supply when floating up, while the float can open the water supply when falling down. The shift of the pole is employed to make packing expand or shrink the deformation end to control the water supply. The above-mentioned descriptions represent merely the exemplary embodiment of the present disclosure, whether the float accommodated in the float cup, pushing the float up by floating of water in the float cup, or making the lever connecting with the float to affect the packing to stop the water supply, are all including in rules of "the float can block the water supply when floating up, while the float can open the water supply when falling down."

The leak-proof toilet tank of the present disclosure further includes a siphon drain devices, a fixed portion disposed on the external surface of the drain for interlocking the second toilet tank hole, a drain hole disposed on the internal surface of the drain, and being connected with the siphon tube disposed on the side surface of the drain, and at least a connecting pipe throughout from a sealed end of the siphon tube then connecting to the above-mentioned float cup or the above-mentioned sub-tank. When the drain hole drains water can cause siphon to drain water from the flat cup or sub-tank.

In the present disclosure, in order to prevent the water from overflowing directly from the toilet tank when a lot of water filling into the toilet tank due to the system failure, a float cover is disposed upward the end of the siphon tube of the siphon tube, the float cover is a floating object, and has a pivot end to pivot a pivot pin disposed on the end of the siphon tube, so that the float cover can switch the drain through hole by a float cover surface disposed on the float cover; wherein the drain through hole is a through hole on the end of the siphon tube, and the float cover surface is a sealed surface of the float cover. When the water level is higher than the drain through hole, the float cover floats up and the drain through hole thus opens, enabling the water to drain from the toilet tank by the drain through hole.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DESCRIPTION OF THE EXEMPLARY EMBODIMENTS

Figure 1A:
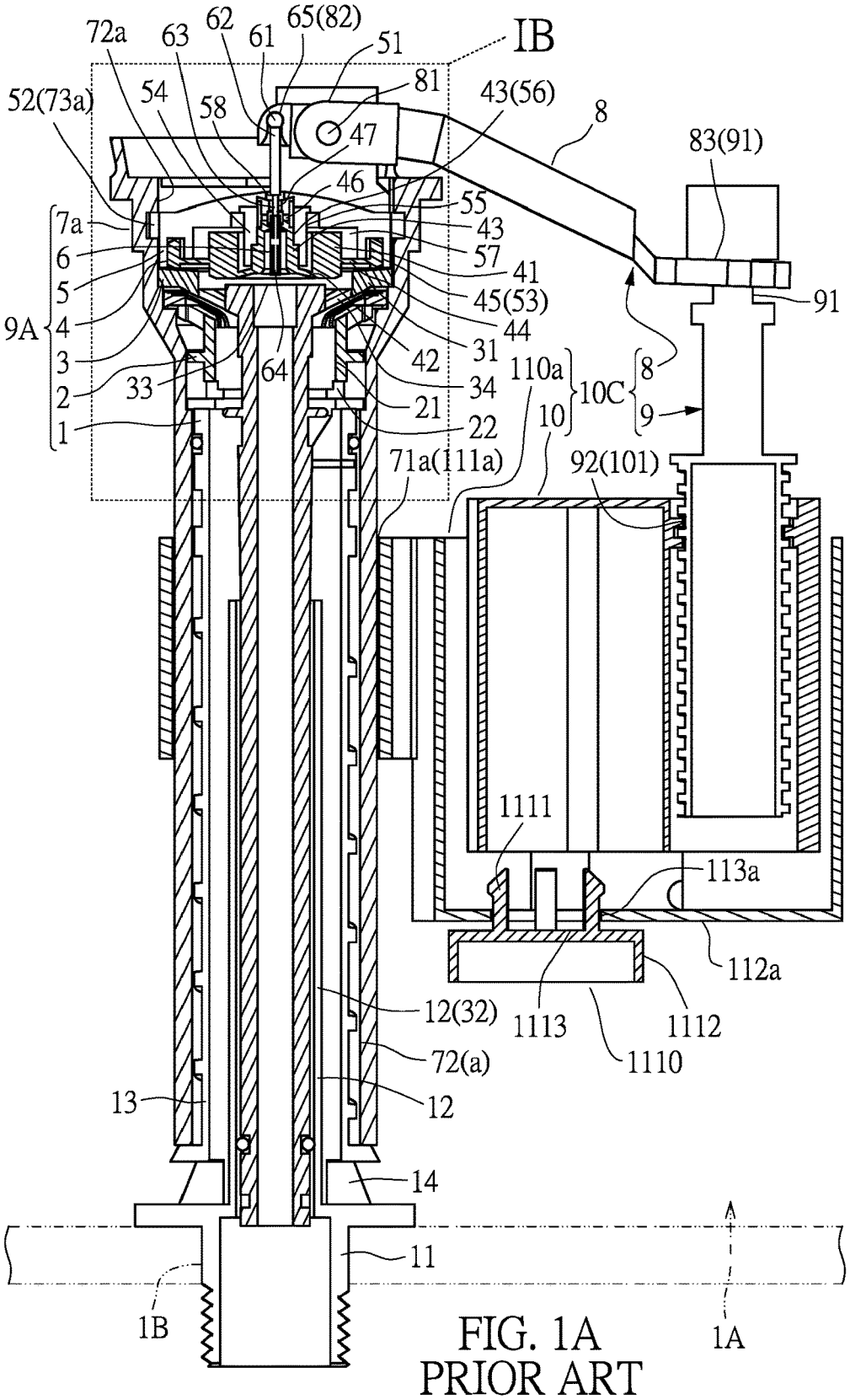
FIG. 1A PRIOR ART
FIG. 1A is a sectional view of a single-water-supply valve in the open state and a second lifting mechanism in the prior art.
Figure 1B:
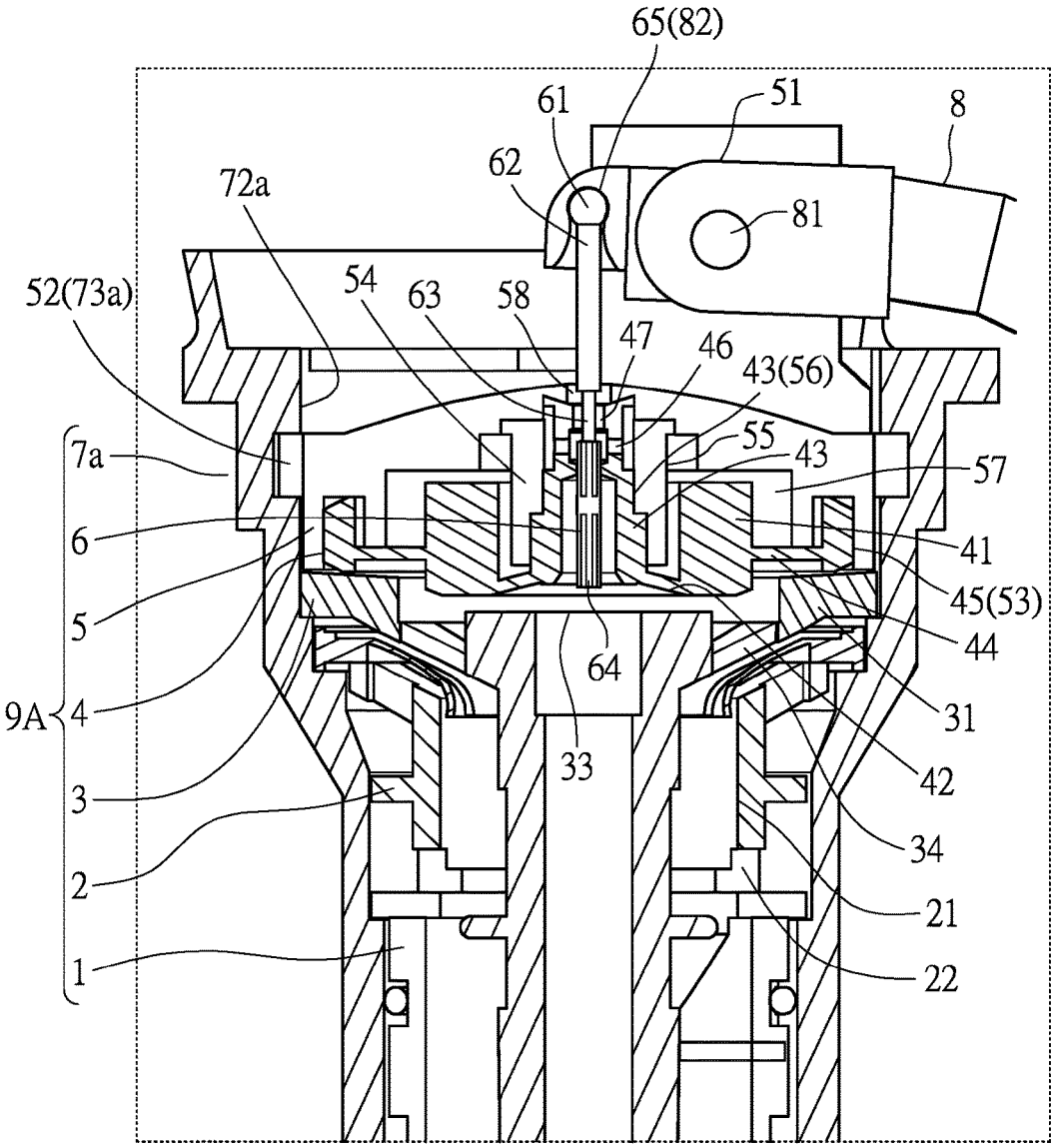
FIG. 1B PRIOR ART
FIG. 1B is an enlarged view of IB in FIG. 1A.
Figure 2:
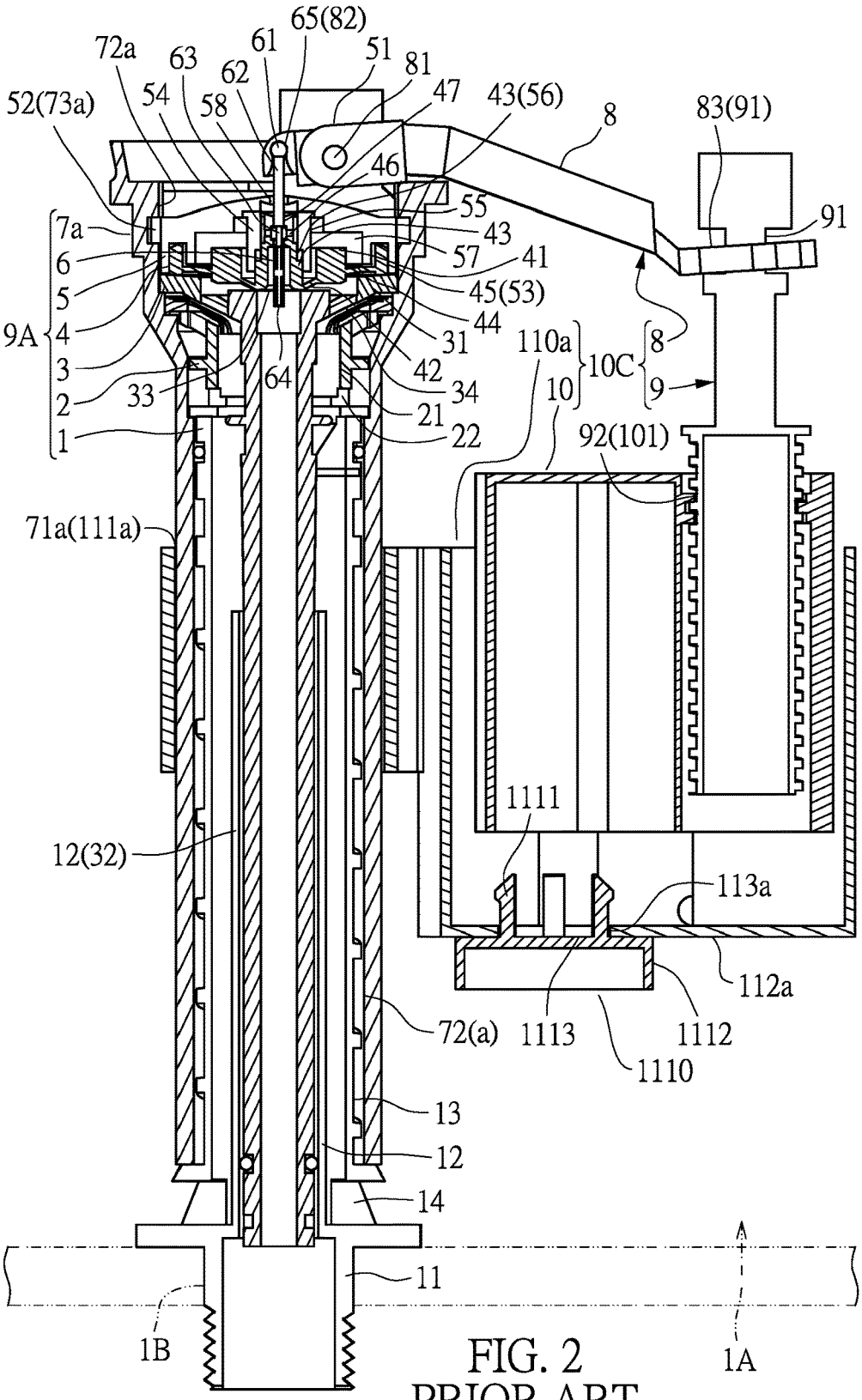
FIG. 2 PRIOR ART
FIG. 2 is a sectional view of a single-water-supply valve in the closed state and a second lifting mechanism in the prior art.

Reference will now be made in detail to the exemplary embodiments of the instant disclosure, examples of which are illustrated in the accompanying drawings. Wherever possible, the same reference numbers are used in the drawings and the description to refer to the same or like parts.

Figure 3:
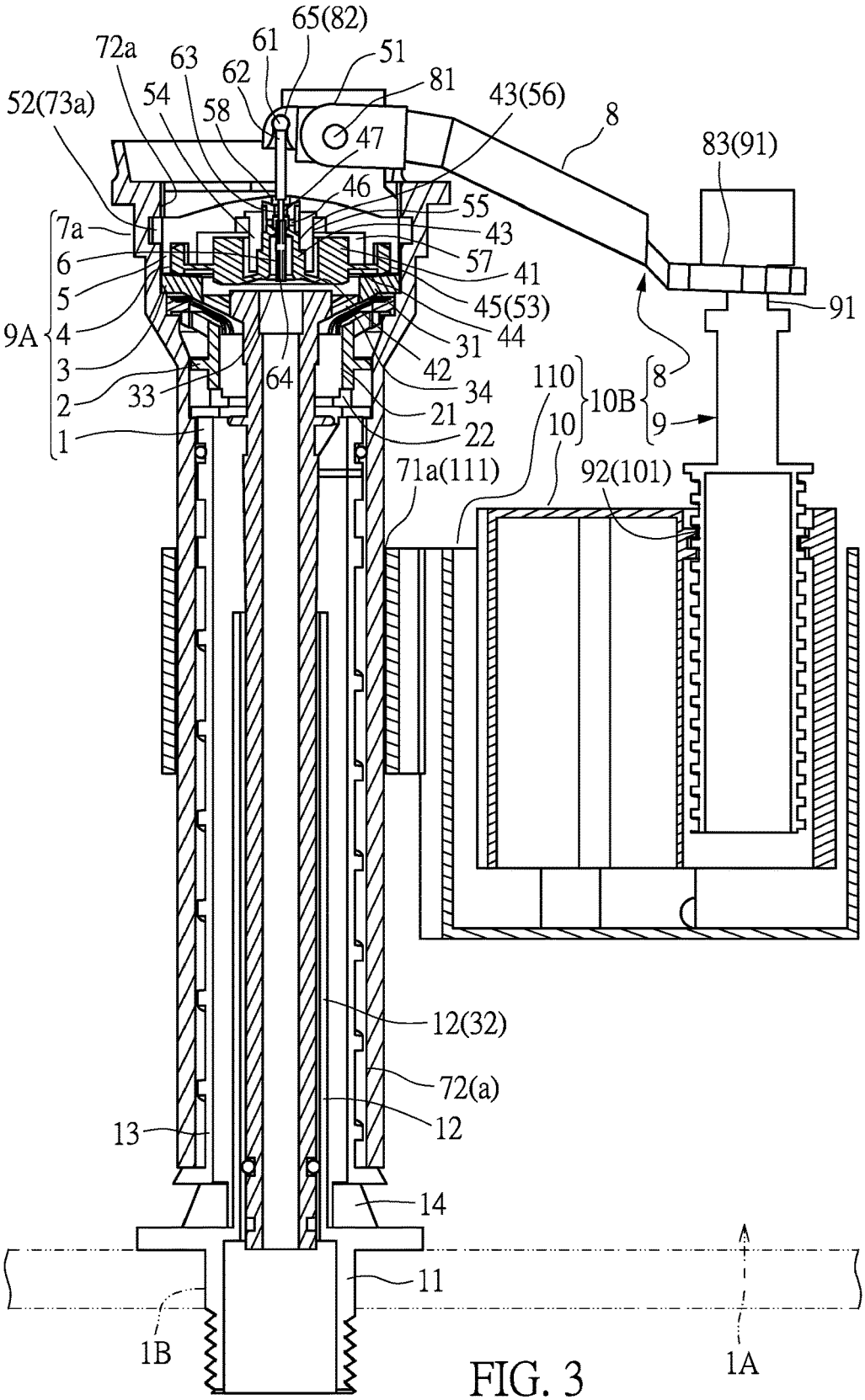
FIG. 3 is a sectional view of the single-water-supply valve in the open state and the first lifting mechanism of the present disclosure.
Figure 4:
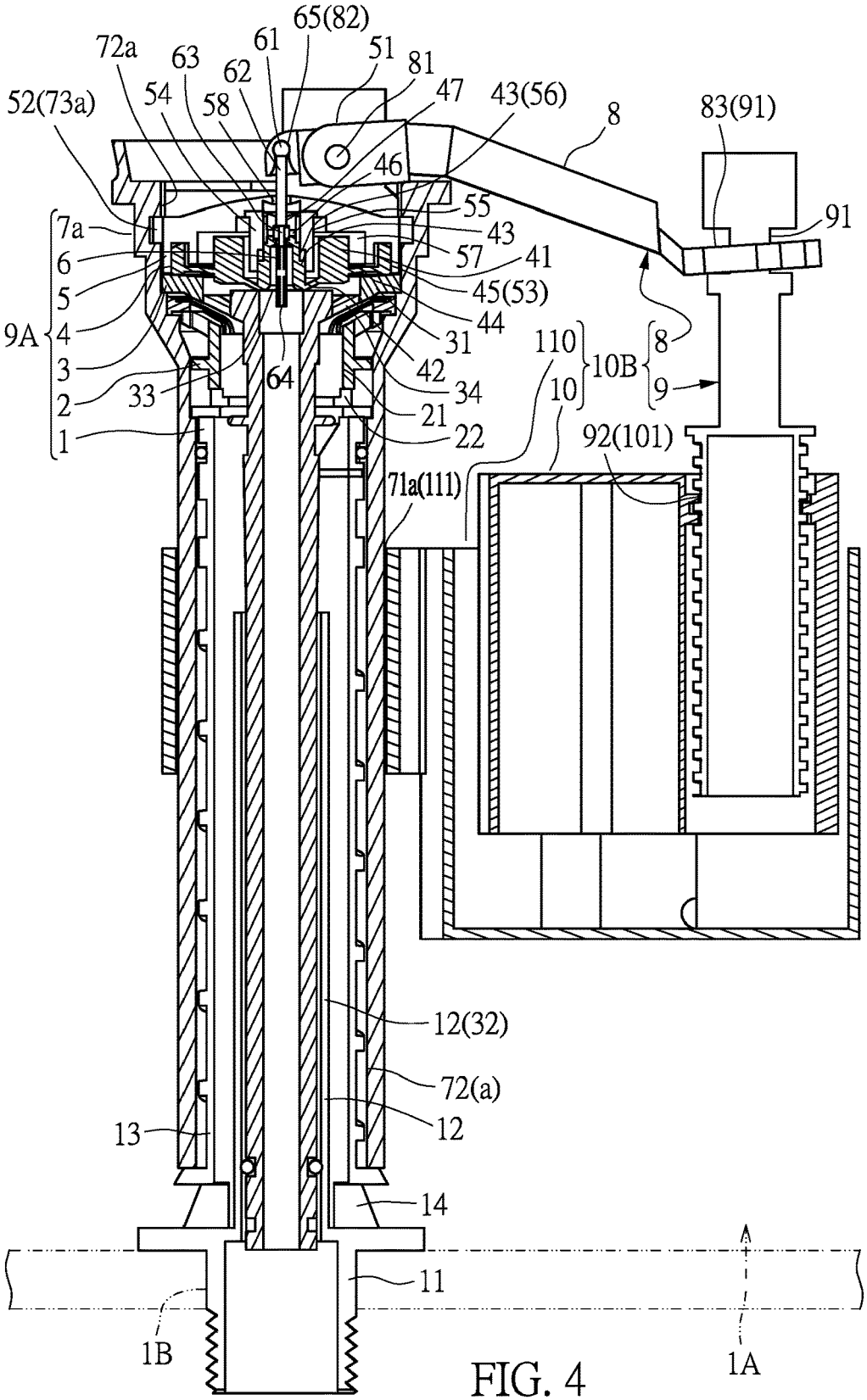
FIG. 4 is a sectional view of the single-water-supply valve in the closed state and the first lifting mechanism of the present disclosure.

Referring to FIG. 3 and FIG. 4, FIG. 3 is a single-water-supply valve 9A in the open state and a first lifting mechanism 10B in the present disclosure, and FIG. 4 is a single-water-supply valve 9A in the closed state and a first lifting mechanism 10B in the present disclosure. The single-water-supply valve 9A includes a jacket tube (1), having a base pipe (11) at the basic point, an external screw thread disposed on the external surface to interlock at the first toilet tank hole (1B). One internal side of the base pipe (11) is connected with water supply, and the other side is extended with an internal pipe (12) and provided with an external pipe (13) surrounding the internal pipe (12). The internal pipe (12) and the external pipe (13) are spaced apart from each other, the external pipe (13) is further provided with a through hole (14) communicating with the toilet tank (1A). A water block (2) is disposed on the external pipe (13) and is provided with an axial through hole (21); a filling tube (3) is composed of a plate segment (31) and a tube section (32), the tube section (32) passes throughout the axial through hole (21) and is interposed in the internal pipe (12) connected with the internal pipe (12); a water outlet (33) of the tube section (32) passes throughout the plate, a groove hole (34) is disposed on the plate throughout the plate segment (31); a packing (4) has a middle portion (41) and is connected with an inner portion (43) by the first deformation end (42) and is connected with an outer portion (45) by a second deformation end (44), wherein, a packing hole (46) is disposed on the top of the inner portion (43) and connected with a axial packing through hole (47) on the top; a valve cover (5) has a pivot end (51) on the top thereof, a latch member (52) outside, and a ring groove (53) inside, adapting to the outer portion (45), the ring groove (53) is surrounded the valve cover (5), and a ring (55) with an air groove hole (54) extending at the central part, wherein, the air groove hole (54) is a groove on the ring (55), and the ring (55) having a ring hole (56) for accommodating the inner portion (43), the surrounding space between the ring (55) and the ring groove (53) is an air room (57), it can be connected to the ring hole (56) by the air groove hole (54), the ring hole (56) is connected with an air hole (58) through the top of the valve cover (5); the pole (6) has a pole head (61) at the top, a pole front (62), a pole middle (63), and a pole back (64). Wherein, the pole middle (63) has a reduced fragment from external diameter between pole front (62) and pole back (64) is called "difference-in-level", and the pole back (64) has a recessed air groove, the pole (6) is throughout the packing through hole (47) of the packing (4) by the air hole (58) of the valve cover (5); A single-water-supply valve body (7*a*) is a tube, axially extending a tube ring surface (71*a*), the opening of the tube inner hole (72*a*) has a latch groove (73*a*), the external pipe (13) of the jacket tube (1) disposed at the tube inner hole (72*a*) at the bottom of the single-water-supply valve body (7*a*), separately placed a water block (2), a filling tube (3), and a packing (4) from the opening of the tube inner hole (72*a*), and makes the latch member (52) of the valve cover (5) latched on the latch groove (73*a*). When the pole (6) moves to open the single-water-supply valve 9A, such that the pole middle (63) of the pole (6) moves to the export side of the packing through hole (47), the water filled into toilet tank (1A) from the recessed air groove of the pole back (64) of the pole (6), through the packing through hole (47), then through the air hole (58) on the top of the valve cover (5), until the water untight the deformation end of the packing (4), and open the water outlet (33), the water outlet (33) is connected to the water source, and it can supply water to the groove hole (34) through the through hole (14) then fill into toilet tank (1A). When the pole (6) moves to close the single-water-supply valve 9A, such that the pole front (62) of the pole (6) moves to block the packing through hole (47) through the packing (4), the water filled into the air room (57) from the recessed air groove of the pole back (64) of the pole (6) through packing hole (46) to the air groove hole (54), the water keep making the deformation end of the packing (4) expended by the water pressure, so that at least one of the inner portion (43) or the middle portion (41) can block the water outlet (33).

Further referring to FIG. 3 and FIG. 4, FIG. 3 is a single-water-supply valve 9A in the open state and a first lifting mechanism 10B in the present disclosure and FIG. 4 is a single-water-supply valve 9A in the closed state and a first lifting mechanism 10B in the present disclosure; wherein, the first lifting mechanism (10B) includes a lever (8), a screw thread (9), a float (10) and a float cup (110); the lever (8) has a pivot pin (81) as a pivot point and pivoting with a pivot end (51) of a valve cover (5); wherein, the front side of the pivot pin (81) is a pivot head as a resistance point and provided with a abutting surface (82), the abutting surface (82) is contacted to the abutting portion (65) of the pole (6); a sleeve hole (83) extending from the end edge of the back side of the pivot pin (81) is used as a force point; The screw thread (9) has a sleeve ring (91) disposed on the surface under the head side, and the sleeve ring (91) is latched with the sleeve hole (83) of the lever (8), an external screw thread (92) disposed under the sleeve ring (91); the float (10) is a floating object, an internal screw thread (101) is threaded to the external screw thread (92); the float cup (110) is a container with an upward opening and the float (10) is accommodated in it. Further, a tube section extending from the side edge of the float cup (110), and a tube hole (111) of the tube section is sleeved around the predetermined position of the tube ring surface (71*a*) of the single-water-supply valve body (7*a*). (a fastening sleeve can be used to fix the float cup (110)), When the stored water of the float cup (110) drains, the float (10) falls down with the water level, also links the screw thread (9) thread to the float (10) falling down, the end side of the lever (8) falls down due to the sleeve ring (91) of the screw thread (9) latched to the end side of the lever (8), further makes the abutting surface (82) of the front side of the pivot pin (81) lifting the abutting portion (65) of the pole (6), moves the pole middle (63) of the pole (6) to the export side of the packing through hole (47), drives the pole (6) to the open state, such that, when the pole middle (63) moves to the export side of the packing through hole (47), the difference-in-level forms a space to release pressure, loses the deformation end of the packing (4) to open the water outlet (33), that is to say, when the float (10) falls down can open the water source; When the stored water of the float cup (110) raises the water level up, the float (10) floats up as well, links the screw thread (9) thread to the float (10) raises up, the end side of the lever (8) raises up due to the sleeve ring (91) of the screw screed (9) latched to the end side of the lever (8), further makes the abutting surface (82) of the front side of the pivot pin (81) depressed the abutting portion (65) of the pole (6), drives the pole (6) to the closed state, such that, when the pole front (62) of the pole (6) can block the packing through hole (47) of the inner portion (43) of the packing (4), the water supply of the water outlet (33) fills into the packing hole (46) through the recessed air groove of the pole back (64) of the pole (6), the water fills into the air room (57), and pressures the deformation end of the packing (4) to expend to block the water outlet (33) of the filling tube (3) by the inner portion (43) or the middle portion (41), that is to say the float (10) can block the water supply when floating up, The above single-water-supply valve (9A) and the first lifting mechanism (10B) of the present disclosure is just an embodiment, the present disclosure defines the general used inlet valve and the common active rules of the lifting mechanism. Accordingly, the float (10) floating up can link the lever (8) to close the water outlet (33) by the deformation end of the packing (4), and vice versa.

Figure 5:
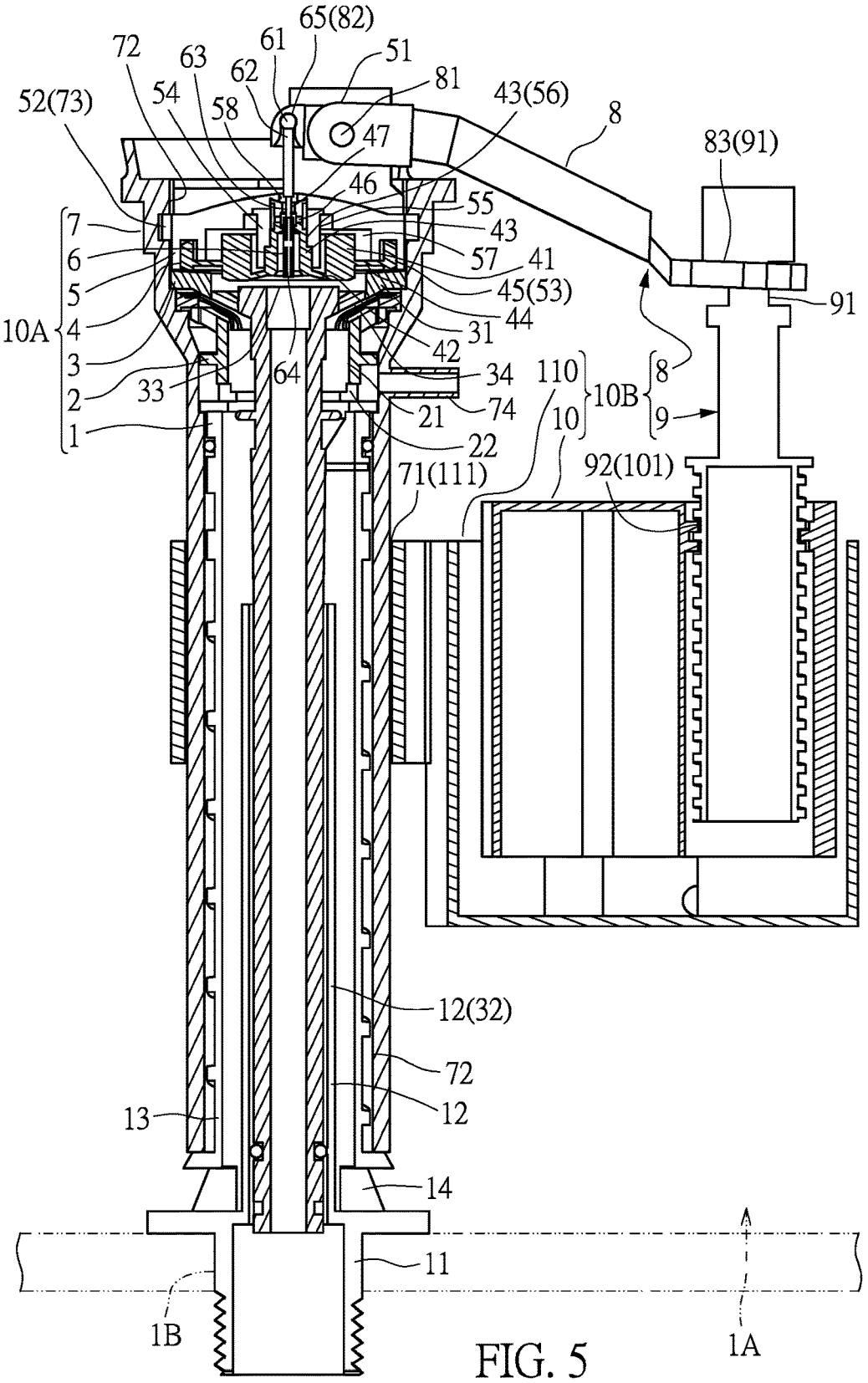
FIG. 5 is a sectional view of the double-water-supply valve in the open state and the first lifting mechanism of the present disclosure.
Figure 6:
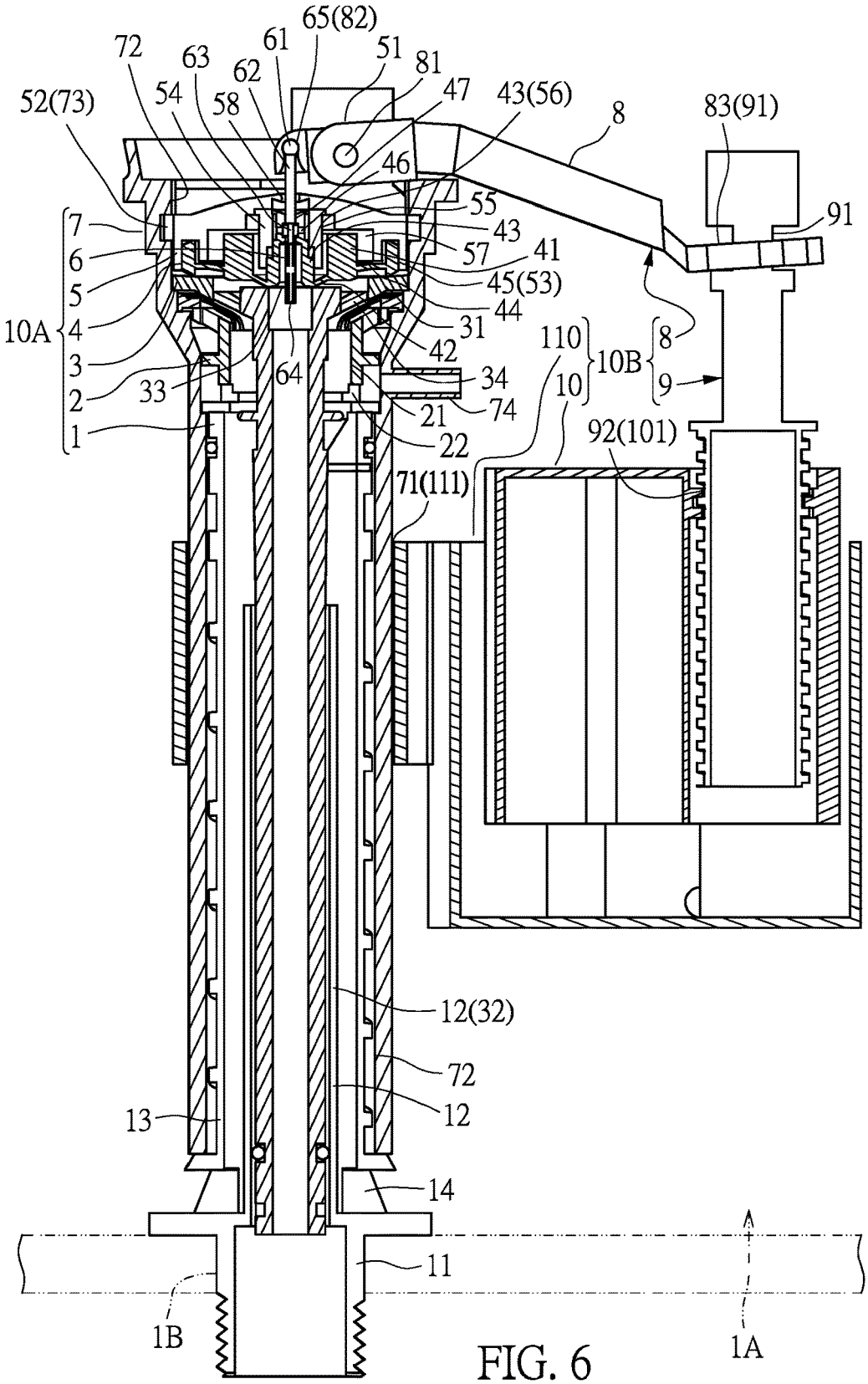
FIG. 6 is a sectional view of the double-water-supply valve in the closed state and the first lifting mechanism of the present disclosure.

Referring to FIG. 5 and FIG. 6, FIG. 5 is a double-water-supply valve 10A in the open state and a first lifting mechanism 10B in the present disclosure; FIG. 6 is a double-water-supply valve 10A in the closed state and a first lifting mechanism 10B in the present disclosure. The double-water-supply valve 10A includes: a jacket tube (1), having a base pipe (11) at the basic point, an external screw thread disposed on the external surface to interlock at the first toilet tank hole (1B). The internal side of the base pipe (11) is connected with water supply, and the other side is extended with an internal pipe (12), and provided with an external pipe (13) surrounding the internal pipe (12); wherein the internal pipe (12) and the external pipe (13) are spaced apart from each other, the external pipe (13) is further provided a through hole (14) to the toilet tank (1A); A water block (2) disposed on the external pipe (13), and is provided with an axial through hole (21); a filling tube (3) is composed of a plate segment (31) and a tube section (32), the tube section (32) throughout the axial through hole (21) and interposed in the internal pipe (12) connected with the internal pipe (12), and a water outlet (33) of the tube section (32) throughout the plate, a groove hole (34) disposed on the plate throughout the plate segment (31); a packing (4) having a middle portion (41) connected with an inner portion (43) by the first deformation end (42), connected with an outer portion (45) by a second deformation end (44), wherein, a packing hole (46) is disposed on the top of the inner portion (43) and connected with a axial packing through hole (47) on the top; a valve cover (5) having a pivot end (51) on the top, a latch member (52) outside, and a ring groove (53) inside, adapting to the outer portion (45), the ring groove (53) is surrounding the valve cover (5), and a ring (55) with an air groove hole (54) extending at the central part, wherein, the air groove hole (54) is a groove on the ring (55), and the ring (55) having a ring hole (56) for accommodating the inner portion (43), the surrounding space between the ring (55) and the ring groove (53) is an air room (57), it can be connected to the ring hole (56) by the air groove hole (54), the ring hole (56) is connected with an air hole (58) through the top of the valve cover (5); A pole (6) has a pole head (61) at the top, a pole front (62), a pole middle (63) at the middle part, and a pole back (64), wherein the pole back (64) has a recessed air groove, in addition, the pole (6) is throughout the packing through hole (47) of the packing (4) by the air hole (58) of the valve cover (5); A double-water-supply valve body (7) is a tube, axially extending a tube ring surface (71), the opening of the tube inner hole (72) has a latch groove (73), the external pipe (13) of the jacket tube (1) disposed at the tube inner hole (72) at the bottom of the single-water-supply valve body (7), separately placed a water block (2), a filling tube (3), and a packing (4) from the opening of the tube inner hole (72), and makes the latch member (52) of the valve cover (5) latched on the latch groove (73). When the pole (6) moves to open the double-water-supply valve 10A, such that the pole middle (63) of the pole (6) moves to the export side of the packing through hole (47), the water filled into toilet tank (1A) from the recessed air groove of the pole back (64) of the pole (6), through the packing through hole (47), then through the air hole (58) on the top of the valve cover (5), until the water untight the deformation end of the packing (4), and open the water outlet (33), the water outlet (33) is connected to the water source, and it can supply water to the groove hole (34) by the water supply pipe (74) or through the through hole (14) then fill into the toilet tank (1A). When the pole (6) moves to close the double-water-supply valve 10A, such that the pole front (62) of the pole (6) moves to block the packing through hole (47) through the packing (4), the water is filled into air room (57) from the recessed air groove of the pole back (64) of the pole (6) through packing hole (46) to the air groove hole (54), the water keeps making the deformation end of the packing (4) expended by the water pressure, so that at least one of the inner portion (43) or the middle portion (41) can block the water outlet (33).

Further referring to FIG. 5 and FIG. 6, FIG. 5 is a double-water-supply valve 10A in open state and a first lifting mechanism 10B in the present disclosure; FIG. 6 is a double-water-supply valve 10A in the closed state and a first lifting mechanism 10B in the present disclosure. Wherein, the first lifting mechanism (10B) includes a lever (8), a screw thread (9), a float (10) and a float cup (110). The lever (8) has a pivot pin (81) as a pivot point, and pivoting with a pivot end (51) of a valve cover (5); wherein, the front side of the pivot pin (81) is a pivot head as a resistance point and provided with a abutting surface (82), the abutting surface (82) is contact to the abutting portion (65) of the pole (6), a sleeve hole (83) extending from the end edge of the back side of the pivot pin (81) is used as a force point; The screw thread (9) has a sleeve ring (91) disposed on the surface under the head side, and the sleeve ring (91) is latched with the sleeve hole (83) of the lever (8), an external screw thread (92) disposed under the sleeve ring (91): The float (10) is a floating object, an internal screw thread (101) is threaded to the external screw thread (92); the float cup (110) is a container with an upward opening and the float (10) is accommodated in it. Further, a tube section extending from the side edge of the float cup (110), and a tube hole (111) of the tube section is sleeved around the predetermined position of the tube ring surface (71) of the double-water-supply valve body (7) (fastening sleeve can be used to fix the float cup (110)). When the stored water of the float cup (110) drains, the float (10) falls down with the water level also links the screw thread (9) thread to the float (10) falling down, the end side of the lever (8) falls down due to the sleeve ring (91) of the screw screed (9) latched to the end side of the lever (8), further makes the abutting surface (82) of the front side of the pivot pin (81) lifting the abutting portion (65) of the pole (6) moves the pole middle (63) of the pole (6) to the export side of the packing through hole (47) drives the pole (6) to open state, such that, when the pole middle (63) moves to the export side of the packing through hole (47), the difference-in-level forms a space to release pressure, loses the deformation end of the packing (4) to open the water outlet (33), that is to say, when the float (10) falls down can open the water source; When the stored water of the float cup (110) raises the water level up, the float (10) floats up as well, links the screw thread (9) thread to the float (10) raises up, the end side of the lever (8) raises up due to the sleeve ring (91) of the screw screed (9) latched to the end side of the lever (8), further makes the abutting surface (82) of the front side of the pivot pin (81) depressed the abutting portion (65) of the pole (6), drives the pole (6) to the closed state, such that, when the pole front (62) of the pole (6) can block the packing through hole (47) of the inner portion (43) of the packing (4), the water supply of the water outlet (33) fills into the packing hole (46) through the recessed air groove of the pole back (64) of the pole (6), the water fills into the air room (57), and pressures the deformation end of the packing (4) to expend to block the water outlet (33) of the filling tube (3) by the inner portion (43) or the middle portion (41), that is to say the float (10) can block the water supply when floating up, that is to say the float (10) can block the water supply when floating up. The above double-water-supply valve (10A) and the first lifting mechanism (10B) of the present disclosure is just an embodiment, the present disclosure defines the general used inlet valve includes single-water-supply valve (9A) and double-water-supply valve (10A) and the common active rules of the lifting mechanism. Accordingly, the float (10) floating up can link the lever (8) to close the water outlet (33) by the deformation end of the packing (4), vice versa.

Figure 7:
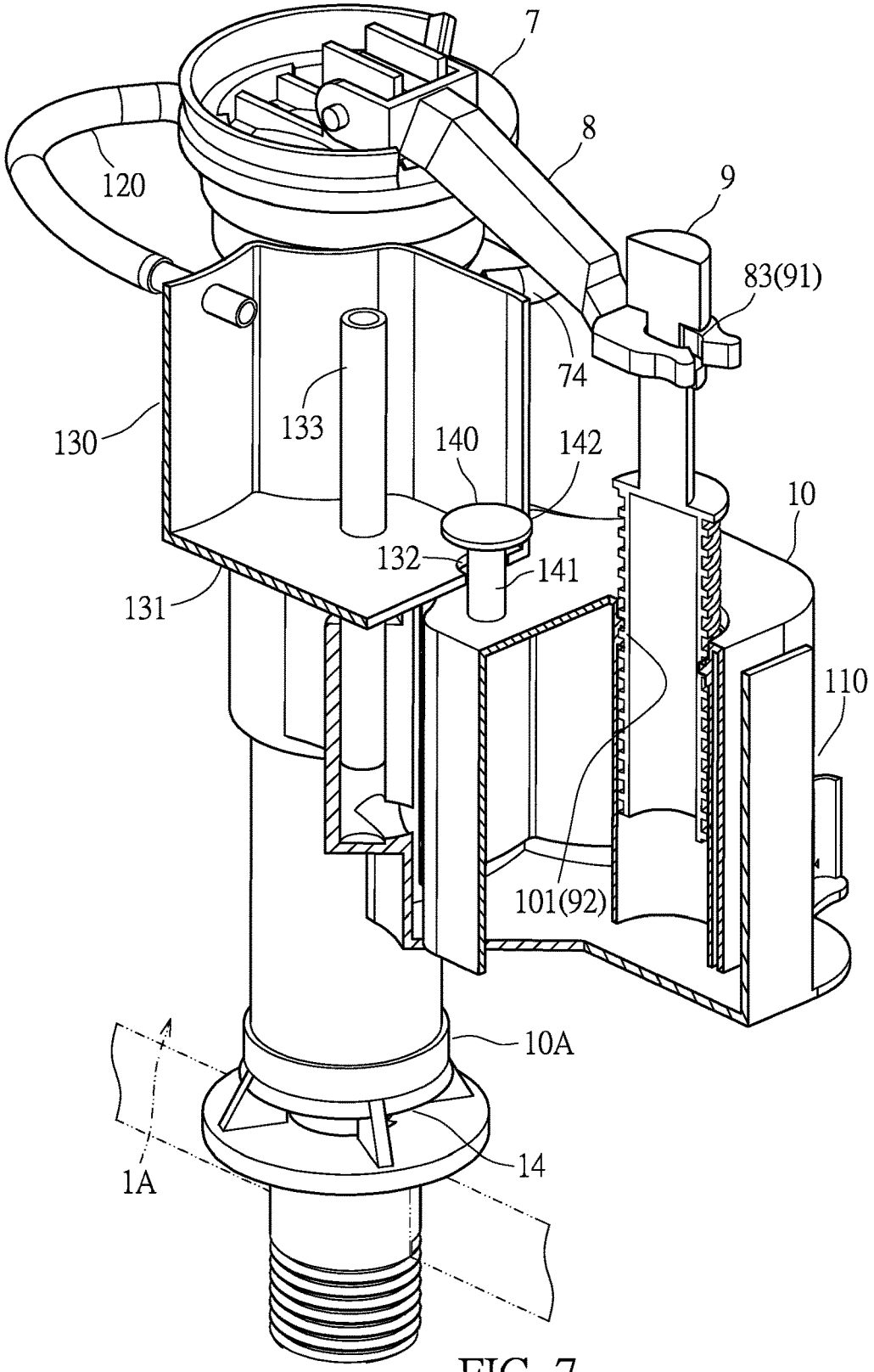
FIG. 7 is a schematic diagram illustrating the action of the sub-tank with a straight pipe of the present disclosure.

Referring to FIG. 5, FIG. 6 and FIG. 7 of the present disclosure, wherein, FIG. 7 is an action diagram of the sub-tank with straight pipe, the double-water-supply valve 10A of FIG. 7 of the present disclosure is the double-water-supply valve 10A of FIG. 5 and FIG. 6 of the present disclosure, includes a jacket tube 1, water block 2, a filling tube 3, a packing 4, a valve cover 5, a pole 6 and a double-water-supply valve body 7, the water outlet (33) of the filling tube 3 connecting to the water source, and supply water to the groove hole (34), and then fill into toilet tank (1A) through the through hole (14); wherein, the through hole 14 of the jacket tube 1 is a water supply system of the double-water-supply valve 10A, the water outlet (33) can also supply water to the groove hole (34), through the water supply pipe (74) of the valve (7), fill into the sub-tank (130) from a water tube (120), and the sub-tank bottom (131) of the sub-tank (130) has a piston hole (132), and a piston body (141) is corresponding disposed thorough the piston hole (132), wherein the outer circumference of the piston body (141) is smaller than the piston hole (132), one side of the piston body (141) is provided with a piston head (142) with larger circumference, so that the piston body (141) can shuttle through the piston hole (132), and opens or closes the piston hole (132) by the piston head (142); Further, the sub-tank with straight pipe (130) has a water pipe connected with the float cup (110), the water pipe is a straight pipe (133). When the water of the sub-tank with straight pipe (130) is over than the opening of the straight pipe (133), the water fill into the float cup (110) by the opening of the straight pipe (133), when the water level of the float cup (110) gets higher, and pushes the top of the float (10) up to open the piston device (140), the stored water of the sub-tank with straight pipe (130) fill into the float cup (110) through the space between the piston hole (132) and the piston body (141), to empty the residual water in the sub-tank with straight pipe (130).

Figure 8:
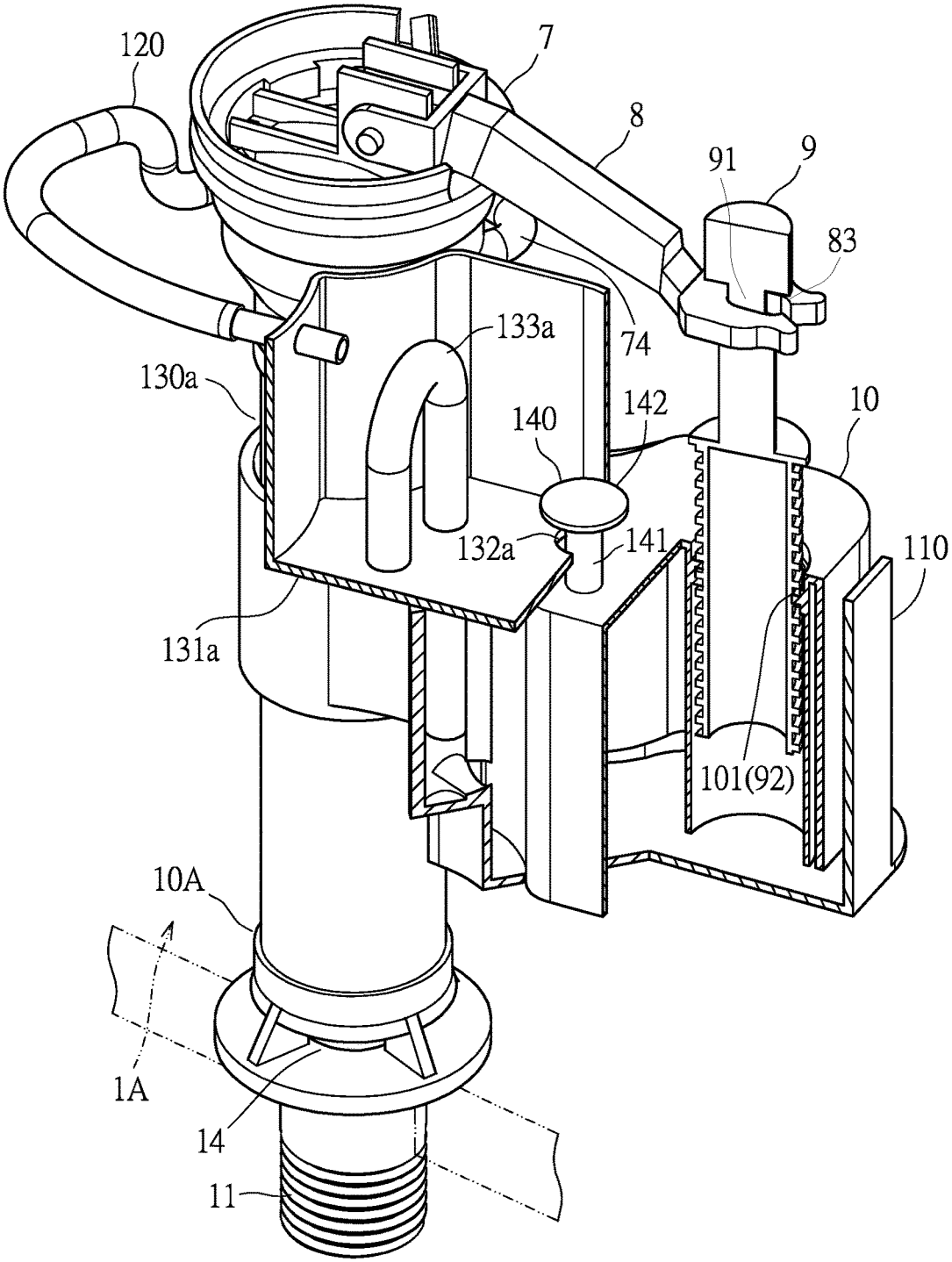
FIG. 8 is a schematic diagram illustrating the action of sub-tank with a siphon of the piston hole of the present disclosure.

Referring to FIG. 5, FIG. 6 and FIG. 8 of the present disclosure, wherein FIG. 8 is an action schematic diagram of the sub-tank with a siphon of the piston hole, the inlet valve 10A in FIG. 8 is the double-water-supply valve 10A in FIG. 5 and FIG. 6, which includes a jacket tube 1, a water block 2, a filling tube 3, a packing 4, a valve cover 5, a pole 6 and a double-water-supply valve body 7, the water outlet (33) of the filling tube 3 connecting to the water source, and supply water to the groove hole (34), and then fill into toilet tank (1A) through the through hole (14), wherein, the through hole 14 of the jacket tube 1 is a water supply system of the double-water-supply valve 10A, the water outlet (33) can also supply water to the groove hole (34), through the water supply pipe (74) of the valve (7), supply water to the sub-tank (130*a*) from the water tube (120) the sub-tank bottom (131*a*) of the sub-tank (130*a*) has a piston hole (132*a*), and a piston body (141) is corresponding disposed thorough the piston hole (132), wherein the outer circumference of the piston body (141) is smaller than the piston hole (132*a*), one side of the piston body (141) is provided with a piston head (142) with larger circumference, so that the piston body (141) can shuttle through the piston hole (132*a*), and opens or closes the piston hole (132*a*) by the piston head (142); Further, the sub-tank with siphon bend pipe (130*a*) has a water pipe connected with the float cup (110), the water pipe is a siphon bend pipe (133*a*). When the water in the sub-tank with siphon bend pipe (130*a*) is over than the bend top of the siphon bend pipe (133*a*), the water is filled into the float cup (110) by the siphon bend pipe (133*a*), when the water level of the float cup (110) gets higher, and pushes the top of the float (10) up to open the piston device (140), the stored water of the sub-tank with siphon bend pipe (130*a*) fill into the float cup (110) through the space between the piston hole (132*a*) and the piston body (141), to empty the residual water in the sub-tank with siphon bend pipe (130*a*).

Figure 9:
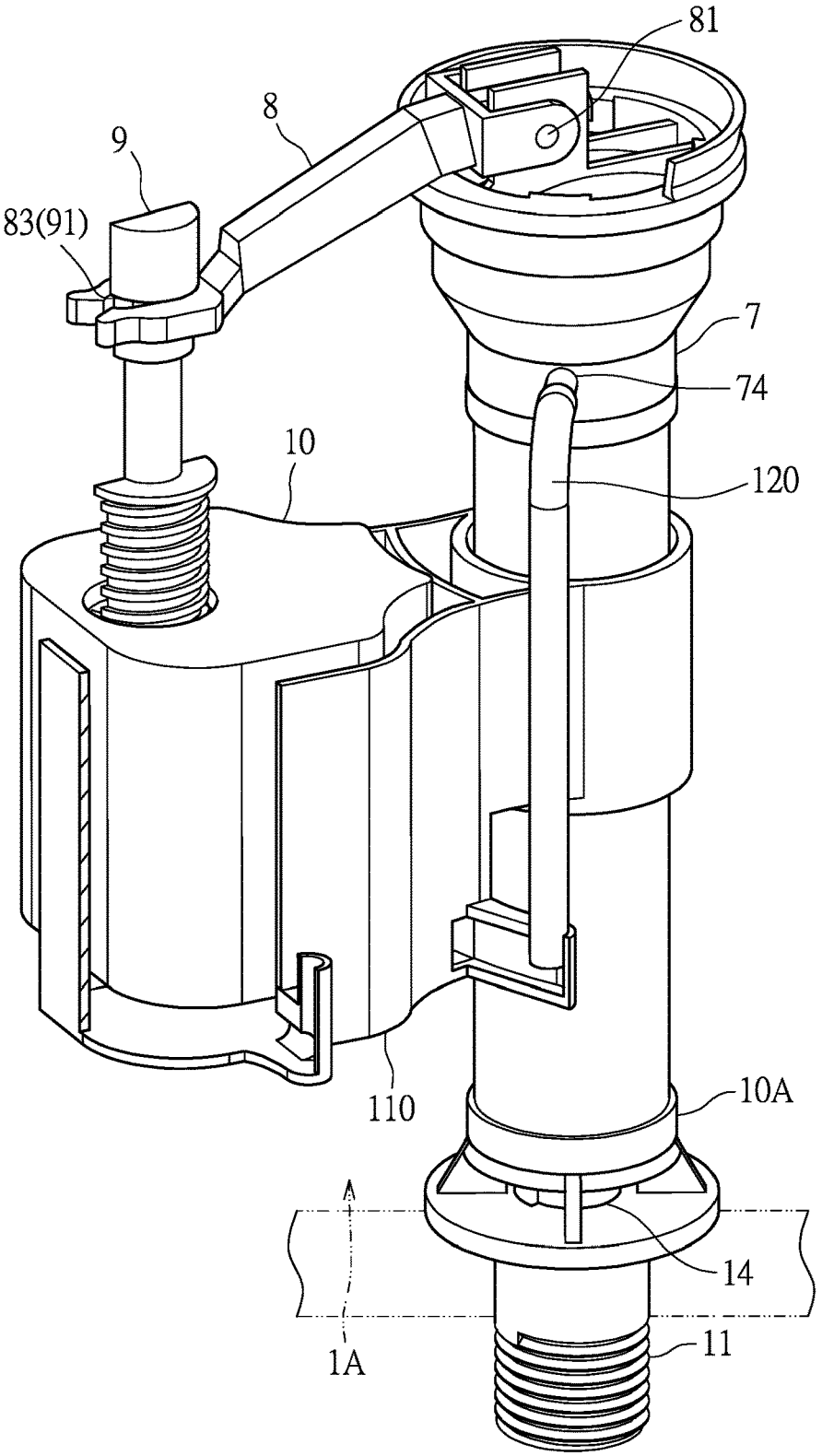
FIG. 9 is a schematic diagram illustrating directly supplying water to the float cup of the present disclosure.

Referring to FIG. 5, FIG. 6 and FIG. 9 of the present disclosure, wherein, FIG. 9 is an action schematic diagram directly supply water to the float cup of the present disclosure, the double-water-supply valve 10A in FIG. 9 is the double-water-supply valve 10A in FIG. 5 and FIG. 6 of the present disclosure, which includes a jacket tube 1, a water block 2, a filling tube 3, a packing 4, a valve cover 5, a pole 6 and a double-water-supply valve body 7, the water outlet (33) of the filling tube 3 is connected to the water source, and supplies water to the groove hole (34), and then fills into toilet tank (1A) through the through hole (14). Wherein, the through hole 14 of the jacket tube 1 is a water supply system of the double-water-supply valve 10A, the water outlet (33) can also supply water to the groove hole (34), through the water supply pipe (74) of the valve (7), fill into a float cup (110) from a water tube (120) directly, and push the float (10) up.

Figure 10C:
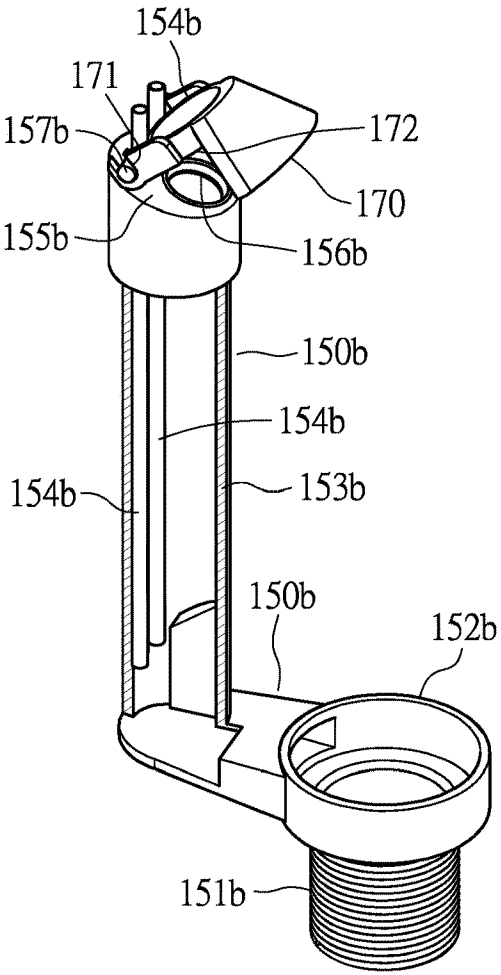
FIG. 10C is a cross-sectional view of the float cover drain device of the present disclosure.
Figure 10B:
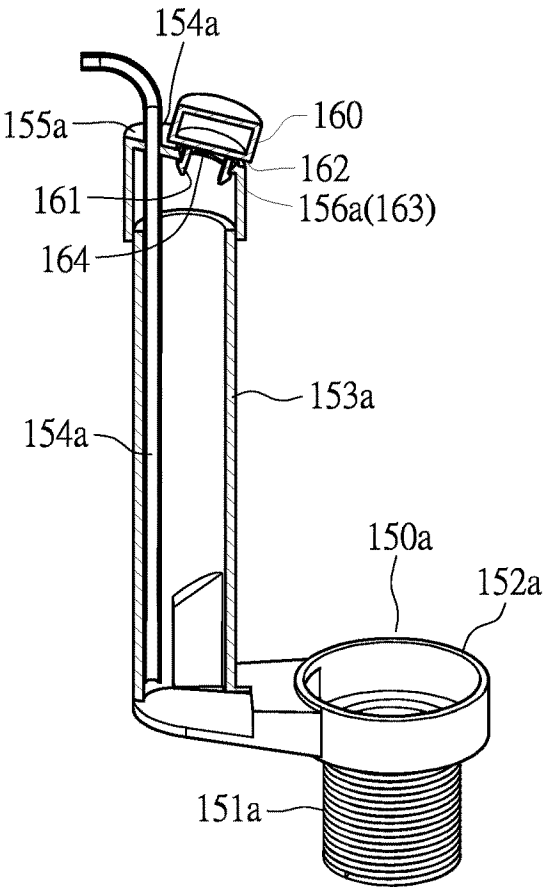
FIG. 10B is a cross-sectional view of the float cover drain device of the present disclosure.
Figure 10A:
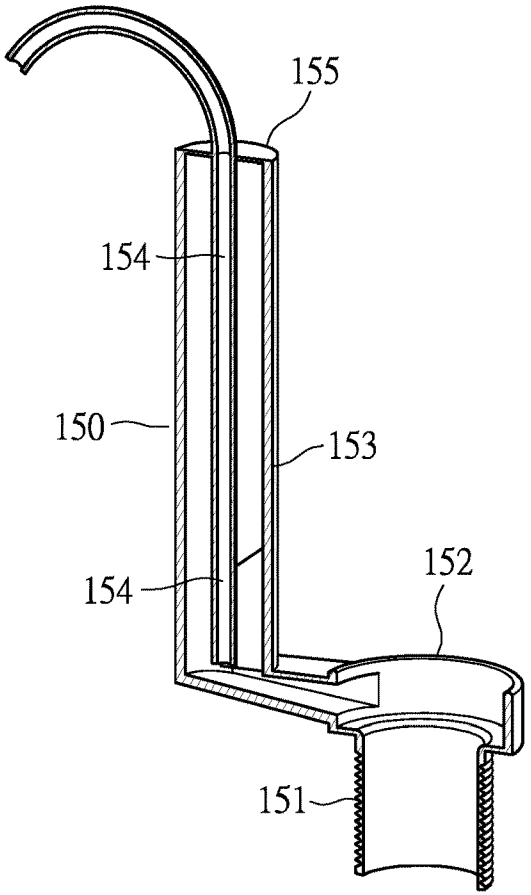
FIG. 10A is a cross-sectional view of the sealed drain device of the present disclosure.
Figure 12:
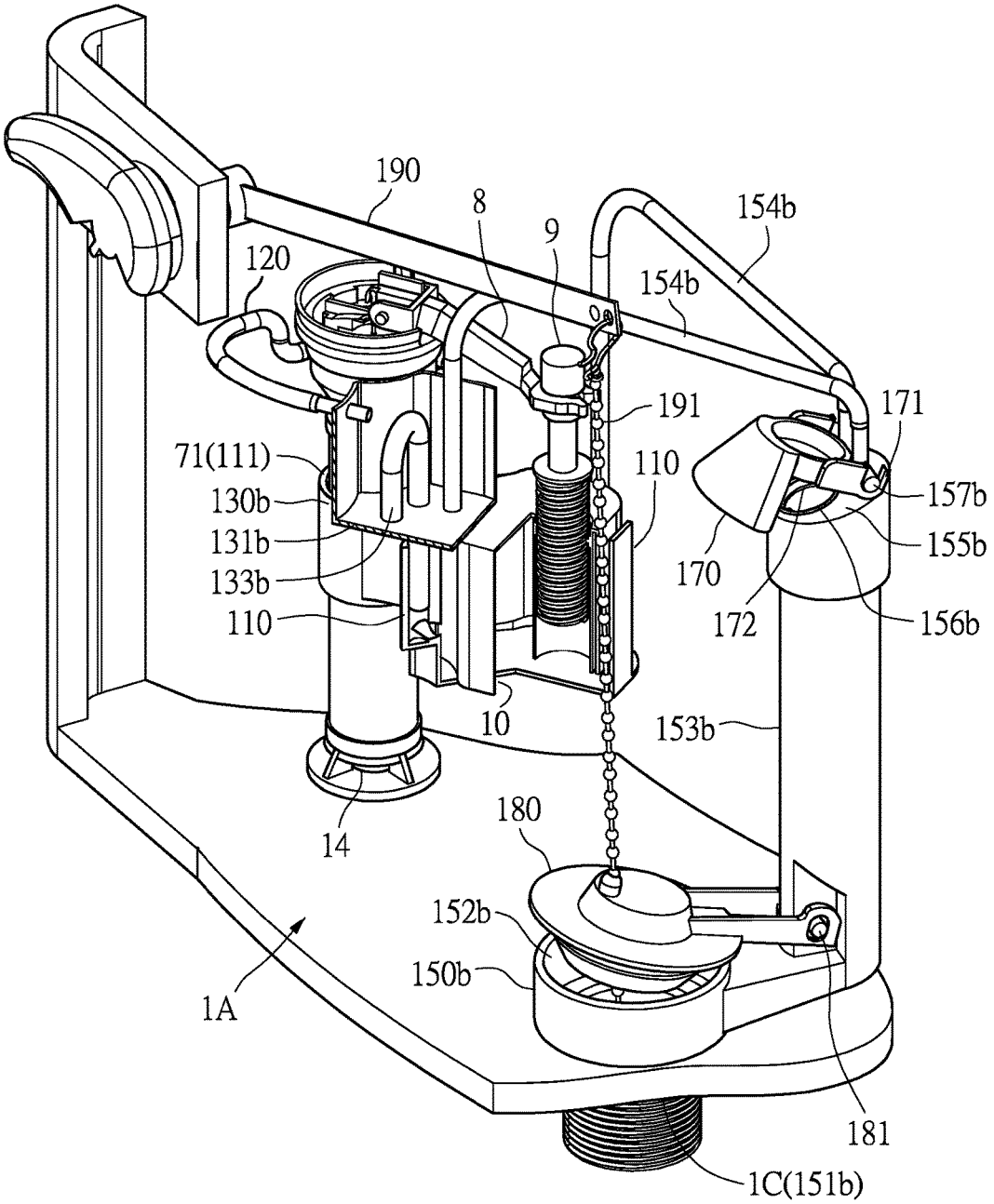
FIG. 12 is a three-dimensional view of the second embodiment of the present disclosure.

Referring to FIG. 7 and FIG. 10A of the present disclosure. FIG. 10A is the sealed drain device (150) of the present disclosure. The drain device (150) has a fixed portion (151) on the outer edge for interlocking to the second toilet tank hole (1C), a drain hole (152) on the inner edge connecting to the siphon tube (153) extending from the side edge, and a connecting pipe (154) throughout from a sealed end of the siphon tube (155) of the siphon tube (153) then connecting to the float cup (110); When the drain hole drains water can cause siphon to drain water out from the float cup (110) of FIG. 7. Referring to FIG. 8 of the present disclosure, cooperating with FIG. 10B of the present disclosure. Wherein, FIG. 10B is a float plug drain device (150*a*) having a fixed portion (151*a*) on the outer edge for interlocking to the second toilet tank hole (1C), wherein, the second toilet tank hole (1C) is a through hole used to arrange and interlock the drain device (150*a*) on the toilet tank (1A), and a drain hole (152*a*) on the inner edge of the drain (150*a*), connecting to the siphon tube (153*a*) extending from the side edge and a connecting pipe (154*a*) throughout from a sealed end of the siphon tube (155*a*) of the siphon tube (153*a*) then connecting to the float cup of FIG. 8 in the present disclosure. When the drain hole drains water can cause siphon to drain water out from the float cup (110) of FIG. 8 of the present disclosure. Wherein, a plug through hole (156*a*) is disposed on the end of the siphon tube (155*a*), a plurality of drain ribs (161) are correspondingly disposed on the float plug (160) to the plug through hole (156*a*), a plug surface (162) larger than the plug through hole (156*a*) is disposed on the top of the drain rib (161), and the plug surface is connected to a sliding section (163) of the drain rib (161), and a hook is disposed on the end of the sliding section (163) of the drain rib (161), so that the sliding section (163) of the drain rib (161) can slide in the plug through hole (156*a*), and opens or closes the plug through hole (156*a*) by the plug surface (162) and the space (164) between the drain rib (161) and the plug through hole (156*a*); and the float plug is a float object, when the water level is higher than the plug through hole (156*a*), the float plug (160) floats up and open the plug through hole (156*a*), so that the stored water drains out from the toilet tank (1A). Referring to FIG. 9 of the present disclosure, it is an action schematic diagram of a directly supply water to the float cup, the double-water-supply valve (10A) supply the water to the toilet tank (1A) through the through hole 14, when the water level of the toilet tank (1A) over than the float cup (110), the water of the float cup (110) can push the float (10) up, and the water supply pipe 74 of the double-water-supply valve (10A) is connected with the water source, supplying the water to the float cup (110) from the water tube (120), the water pressure of float cup (110) ensure the float (10) can be pushed to the predetermined position, when the toilet tank (1A) leak water, it can be used to supply water by the water tube (120) directly to the float cup (110) and make the float (10) pushed to the predetermined position to block the water source. Referring to FIG. 12 and FIG. 10C of the present disclosure, wherein, FIG. 10C is a float cover drain device (150*b*), having a fixed portion (151*b*) on the outer edge for interlocking to the second toilet tank hole (1C), a drain hole (152*b*) on the inner edge, connecting to the siphon tube (153*b*) extending from the side edge, and at least a connecting pipe (154*b*) throughout from a sealed end of the siphon tube (155*b*) of the siphon tube (153*b*), then connecting to the float cup or the sub-tank without piston hole (130*b*) of FIG. 12 of the present disclosure. When the drain hole drains water can cause siphon to drain water out from the float cup (110) and sub-tank without piston hole (130*b*) of FIG. 12 of the present disclosure. A end of the siphon tube (155*b*) is disposed on drain through hole (156*b*), and a float cover (170) is disposed upward the end of the siphon tube (155*b*), the float cover (170) is a floating object, and having a pivot end (171) to pivot a pivot pin (157*b*) disposed on the end of the siphon tube (155*b*), the float cover (170) can switch the drain through hole (156*b*) by a float cover surface (172) disposed on the float cover. When the water level in the toilet tank (1A) is higher than the drain through hole (156*b*), the float cover (170) floats up and opens the drain through hole (156*b*), so that the water drains out from the toilet tank by the drain through hole Further referring to FIG. 10A, the sealed drain device (150) of the present disclosure, and FIG. 10B is the float plug drain device (150*a*) of the present disclosure and FIG. 10C float cover drain device (150*b*) of the present disclosure, each connecting pipe (154) (154*a*) (154*b*) connects to the float cup (110) or the sub-tank without piston hole (130*b*), and drain the stored water of that when the drain hole (152, 152*a*, 152*b*) drains.

Figure 11:
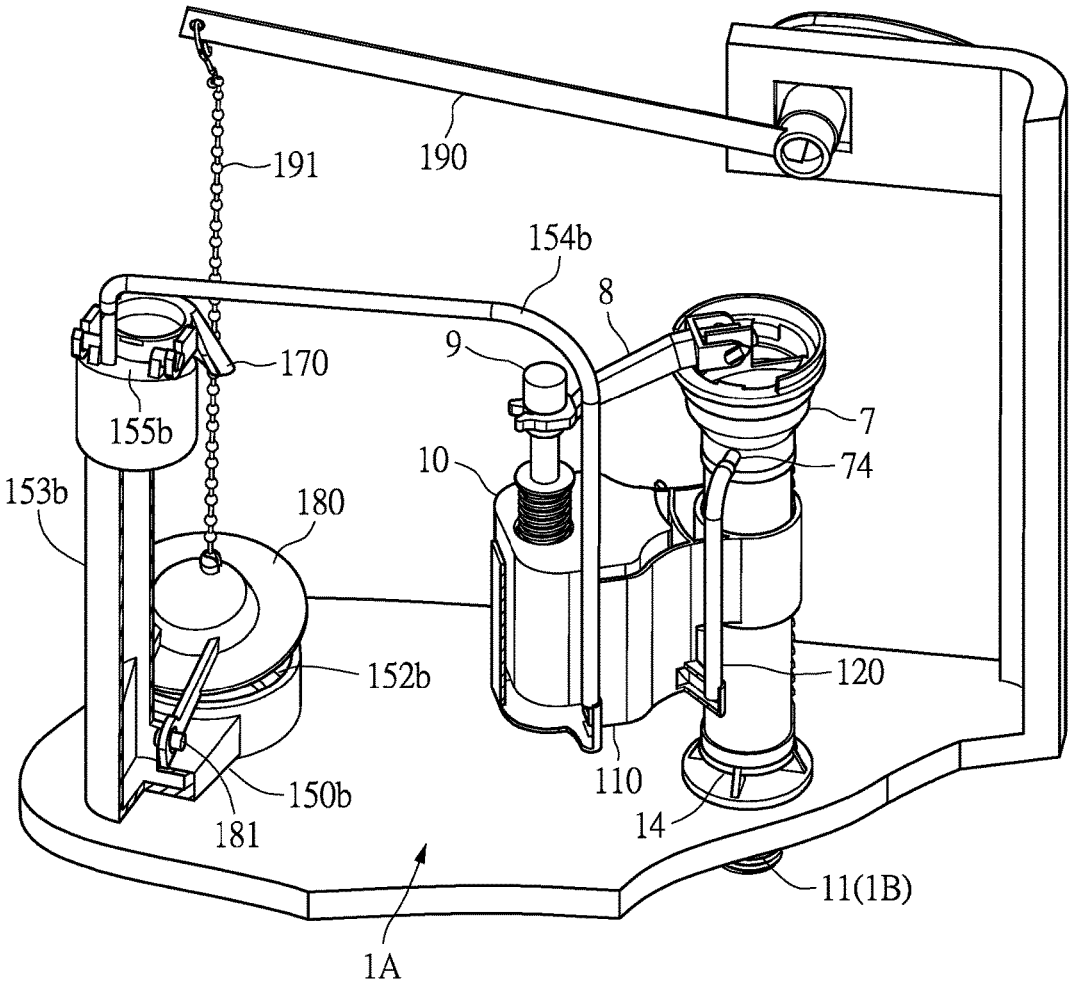
FIG. 11 is a three-dimensional view of the first embodiment of the present disclosure.

Referring to FIG. 11, it is the first embodiment of the present disclosure, the water supply pipe (74) of the double-water-supply valve body (7) delivers water from the water tube (120) to a float cup (110), and the water inside the float cup (110) pushes the float (10) up by floating, a float cover drain device (150*b*) disposed in the toilet tank (1A), and the float cup (110) connecting to the siphon tube (153*b*) by a connecting pipe (154*b*) of the float cover drain device (150*b*), and the float cover drain device (150*b*) is provided with a drain hole (152*b*) to drain the stored water of toilet tank (1A) to the toilet, and causes siphon effect. The drain hole (152*b*) is connected with the siphon tube (153*b*), when the drain hole (152*b*) drains, the stored water in the float cup (110) can be drained out of the toilet tank (1A) together, the water of the float cup (110) draining out makes the float (10) falling down, so that the water supply pipe (74) would re-fill water. The drain hole (152*b*) is provided with a drain cover (180), coordinating with the pivot assembly (181) at the end of the drain hole (152*b*), it can open or close the drain hole (152*b*) by a chain (191) of the tank lever (190). Referring to FIG. 12, it is the other embodiment of the present disclosure, a float cover drain device (150*b*) is interlocked to the first toilet tank hole (1C) of the toilet tank (1A) by the fixed portion (151*b*), and the float cup (110) is connected with a siphon tube (153*b*) of the float cover drain device (150*b*) by a connecting pipe (154*b*), and the float cover drain device (150*b*) is provided with a drain hole (152*b*) to drain the stored water of toilet tank (1A) to the toilet, and causes siphon effect. The drain hole (152*b*) is connected with the siphon tube (153*b*), when the drain hole (152*b*) drains, the stored water in the float cup (110) can be drained out of the toilet tank (1A) together, the water of the float cup (110) draining out makes the float (10) falling down, so that the water supply pipe (74) would re-fill water. The drain hole (152*b*) is provided with a drain cover (180), coordinating with the pivot assembly (181) at the end of the drain hole (152*b*), it can open or close the drain hole (152*b*) by a chain (191) of the tank lever (190). A sub-tank without piston hole (130*b*) is shown in FIG. 12, a siphon bend pipe (133*b*) is disposed in the sub-tank without piston hole (130*b*), and connecting to the float cup (110), when the water tube (120) delivers the water to a sub-tank without piston hole (130*b*), the water level over the bend top of the siphon bend pipe (133*b*), the stored water in the sub-tank without piston hole (130*b*) flows to the float cup (110), pushing the float 10 in the float cup (110) up, and the sub-tank without piston hole (130*b*) is connected to a siphon tube (153*b*) on the float cover drain device (150*b*), and the float cover drain device (150*b*) is provided with a drain hole (152*b*) to drain the stored water of toilet tank (1A) to the toilet, and causes siphon effect. The drain hole (152*b*) is connected with the siphon tube (153*b*), when the drain hole (152*b*) drains, the rest water in the sub-tank without piston hole (130*b*) can be drained out of the toilet tank (1A) together.

The above-mentioned descriptions represent merely the exemplary embodiment of the present disclosure, without any intention to limit the scope of the instant disclosure thereto. Various equivalent changes, alterations or modifications based on the claims of the instant disclosure are all consequently viewed as being embraced by the scope of the instant disclosure.

What is claimed is:

1. A leak-proof toilet tank, comprising:

a toilet tank, which is a container with an upward opening, wherein, the bottom of the toilet tank is provided with a first toilet tank hole and a second toilet tank hole penetrating therethrough separately;

a single-water-supply valve, wherein, one side of the single-water-supply valve is threaded to the first toilet tank hole, the single-water-supply valve has a through hole connecting with water source for filling water into the toilet tank, the single-water-supply valve includes a single-water-supply valve body, the single-water-supply valve body is disposed outside the single-water-supply valve, the single-water-supply valve body is a pipe, and a tube ring surface extends along the axial direction of the single-water-supply valve body;

a float cup, which is a container with a sealed bottom and an upward opening, wherein, the float cup is accommodated in the toilet tank, the water is supplied to the toilet tank through the through hole, and the water of the toilet tank overflows the float cup when the water level of the toilet tank is excessively high; wherein, the float cup has a tube section, a tube hole is formed in the tube section of the float cup, and the tube hole is sleeved around a predetermined position of the tube ring surface of the single-water-supply valve body;

a float, which is a floating object, wherein the float is accommodated in the float cup and pushed to a predetermined position by the water in the float cup to block the water supply of the water source; when the water level of the toilet tank is reduced due to water leakage, the water level in the float cup is not changed and the float is maintained at the predetermined position; and a sealed drain device, disposed in the toilet tank, the outer edge of the sealed drain device having a fixed portion for fixing the sealed drain device in the second toilet tank hole, a drain hole disposed on the inner edge on the sealed drain device, wherein the water is drained from the toilet tank by the drain hole; a siphon tube is extended on a side edge of the sealed drain device, and at least one connecting pipe from the siphon tube passes through the end of the siphon tube and is connected with the float cup, wherein, the end of the siphon tube is a sealed surface of the siphon tube; when the drain hole drains, the water stored in the float cup is discharged by siphon effect.

2. The leak-proof toilet tank according to claim 1, wherein, the end of the siphon tube of the siphon tube includes a plug through hole, a plurality of drain ribs are correspondingly disposed on a float plug of the plug through hole, a plug surface which is larger than the plug through hole is disposed on the top of the drain rib, the plug surface is connected to a sliding section of the drain rib, and a hook is disposed on the end of the sliding section of the drain rib, so that the sliding section of the drain rib slides in the plug through hole, and opens or closes the plug through hole by the plug surface and the space between the drain rib and the plug through hole; wherein, the plug surface is a sealed surface of the float plug, and the float plug is a float object; when the water level is higher than the plug through hole, the float plug floats up and opens the plug through hole.

3. The leak-proof toilet tank according to claim 1, wherein, the end of the siphon tube of the siphon tube is provided with a drain through hole, the drain through hole is disposed on the end of the siphon tube, a float cover is disposed on the drain through hole, the float cover is a floating object and has a pivot end to pivot a pivot pin disposed on the end of the siphon tube, a float cover surface is disposed on the float cover, and opens or closes the drain through the drain through hole by the float cover surface and the pivot end and the pivot pin; wherein, the float cover surface is a sealed surface of the float cover, when the water level is higher than the drain through hole, the float cover floats up and opens the drain through hole.

4. A leak-proof toilet tank, comprising:

a toilet tank, which is a container with an upward opening, wherein, the bottom of the toilet tank is provided with a first toilet tank hole and a second toilet tank hole penetrating therethrough separately;

a double-water-supply valve, wherein one side of the double-water-supply valve is threaded to the first toilet tank hole, the double-water-supply valve has a through hole connecting with water source for filling water into the toilet tank, the double-water-supply valve includes a double-water-supply valve body, the double-water-supply valve body is disposed outside the double-water-supply valve, the double-water-supply valve body is a pipe, and a tube ring surface extends along the axial direction of the double-water-supply valve body, and a water supply pipe connecting to water supply extends along the radial direction of the double-water-supply valve body;

a water tube, connecting to the water supply pipe for delivering the water from the water supply pipe;

a float cup, which is a container with a sealed bottom and an upward opening, wherein, the float cup is accommodated in the toilet tank, the float cup stores the water from the water tube, the water is supplied to the toilet tank through the through hole, and the water of the toilet tank overflows the float cup when the water level of the toilet tank is excessively high; when the toilet tank is unable to supply the water to the float cup due to water leakage, the float cup provides water through the water tube; the float cup has a tube section, and the tube section is sleeved around a predetermined position of the tube ring surface of the double-water-supply valve body;

a float, which is a floating object, wherein the float is accommodated in the float cup and pushed to a predetermined position by the water in the float cup to block water supply of a water source; when the water level of the toilet tank is reduced due to water leakage, the water level in the float cup is not changed and the float is maintained at the predetermined position; and a sealed drain device, disposed in the toilet tank, the outer edge of the sealed drain device having a fixed portion for fixing the sealed drain device in the second toilet tank hole, a drain hole disposed on the inner edge on the sealed drain device, wherein the water is drained from the toilet tank by the drain hole; a siphon tube is extended on a side edge of the sealed drain device, and at least one connecting pipe from the siphon tube passes through the end of the siphon tube and is connected with the float cup, wherein, the end of the siphon tube is a sealed surface of the siphon tube; when the drain hole drains, the water stored in the float cup is discharged by siphon effect.

5. The leak-proof toilet tank according to claim 4, wherein the float cup stores the water directly delivered from the water tube.

6. The leak-proof toilet tank according to claim 4, wherein the float cup stores the water delivered indirectly from the water tube, the water tube delivers the water to a sub-tank, the sub-tank is a container disposed on the float cup, the sub-tank is provided with a water pipe for sending the water in the sub-tank to the float cup connected to the sub-tank, wherein, the water pipe is a pipe for delivering water in the sub-tank to the float cup, the bottom of the sub-tank is provided with a piston hole, and a piston body is disposed corresponding to the piston hole, an outer circumference of the piston body is smaller than the piston hole, one side of the piston body is provided with a piston head with a larger circumference, so that the piston body passes through the piston hole, and opens or closes the piston hole by the piston head; the float is pushed by the water flowing into the float cup by the water pipe; when the float is pushed to a predetermined position, the float pushes the piston, so that the water in the sub-tank is discharged into the float cup.

7. The leak-proof toilet tank according to claim 6, wherein, the water pipe of the sub-tank is a straight pipe, so that the sub-tank is formed to be a sub-tank with straight pipe, when the water level of the sub-tank with straight pipe exceeds the opening of the straight pipe, the water in the sub-tank with straight pipe overflows the float cup by the straight pipe.

8. The leak-proof toilet tank according to claim 7, wherein, the end of the siphon tube of the siphon tube includes a plug through hole, a plurality of drain ribs are correspondingly disposed on a float plug of the plug through hole, a plug surface which is larger than the plug through hole is disposed on the top of the drain rib, the plug surface is connected to a sliding section of the drain rib, and a hook is disposed on the end of the sliding section of the drain rib, so that the sliding section of the drain rib slides in the plug through hole, and opens or closes the plug through hole by the plug surface and the space between the drain rib and the plug through hole; wherein, the plug surface is a sealed surface of the float plug, and the float plug is a float object; when the water level is higher than the plug through hole, the float plug floats up and opens the plug through hole.

9. The leak-proof toilet tank according to claim 7, wherein, the end of the siphon tube of the siphon tube is provided with a drain through hole, the drain through hole is disposed on the end of the siphon tube, a float cover is disposed on the drain through hole, the float cover is a floating object and has a pivot end to pivot a pivot pin disposed on the end of the siphon tube, a float cover surface is disposed on the float cover, and opens or closes the drain through the drain through hole by the float cover surface and the pivot end and the pivot pin; wherein, the float cover surface is a sealed surface of the float cover, when the water level is higher than the drain through hole, the float cover floats up and opens the drain through hole.

10. The leak-proof toilet tank according to claim 6, wherein, the water pipe of the sub-tank is a siphon bend pipe, so that the sub-tank is formed to be a sub-tank with siphon bend pipe; when the water level of the sub-tank with siphon bend pipe exceeds the bend top of the siphon bend pipe of the sub-tank with siphon bend pipe, the water in the sub-tank with siphon bend pipe flows the float cup by siphon effect.

11. The leak-proof toilet tank according to claim 10, wherein, the end of the siphon tube of the siphon tube includes a plug through hole, a plurality of drain ribs are correspondingly disposed on a float plug of the plug through hole, a plug surface which is larger than the plug through hole is disposed on the top of the drain rib, the plug surface is connected to a sliding section of the drain rib, and a hook is disposed on the end of the sliding section of the drain rib, so that the sliding section of the drain rib slides in the plug through hole, and opens or closes the plug through hole by the plug surface and the space between the drain rib and the plug through hole; wherein, the plug surface is a sealed surface of the float plug, and the float plug is a float object; when the water level is higher than the plug through hole, the float plug floats up and opens the plug through hole.

12. The leak-proof toilet tank according to claim 10, wherein, the end of the siphon tube of the siphon tube is provided with a drain through hole, the drain through hole is disposed on the end of the siphon tube, a float cover is disposed on the drain through hole, the float cover is a floating object and has a pivot end to pivot a pivot pin disposed on the end of the siphon tube, a float cover surface is disposed on the float cover, and opens or closes the drain through the drain through hole by the float cover surface and the pivot end and the pivot pin; wherein, the float cover surface is a sealed surface of the float cover, when the water level is higher than the drain through hole, the float cover floats up and opens the drain through hole.

13. The leak-proof toilet tank according to claim 6, wherein, the end of the siphon tube of the siphon tube includes a plug through hole, a plurality of drain ribs are correspondingly disposed on a float plug of the plug through hole, a plug surface which is larger than the plug through hole is disposed on the top of the drain rib, the plug surface is connected to a sliding section of the drain rib, and a hook is disposed on the end of the sliding section of the drain rib, so that the sliding section of the drain rib slides in the plug through hole, and opens or closes the plug through hole by the plug surface and the space between the drain rib and the plug through hole; wherein, the plug surface is a sealed surface of the float plug, and the float plug is a float object; when the water level is higher than the plug through hole, the float plug floats up and opens the plug through hole.

14. The leak-proof toilet tank according to claim 6, wherein, the end of the siphon tube of the siphon tube is provided with a drain through hole, the drain through hole is disposed on the end of the siphon tube, a float cover is disposed on the drain through hole, the float cover is a floating object and has a pivot end to pivot a pivot pin disposed on the end of the siphon tube, a float cover surface is disposed on the float cover, and opens or closes the drain through the drain through hole by the float cover surface and the pivot end and the pivot pin; wherein, the float cover surface is a sealed surface of the float cover, when the water level is higher than the drain through hole, the float cover floats up and opens the drain through hole.

15. The leak-proof toilet tank according to claim 4, wherein, the float cup stores the water delivered indirectly by the water tube, the water tube delivers the water to a sub-tank without piston hole, the sub-tank without piston hole is a container disposed on the float cup, a water pipe is disposed in the sub-tank without piston hole for delivering the water from the sub-tank without piston hole to the float cup connecting to the sub-tank without piston hole, wherein the water pipe is a siphon bend pipe; when the water level of the sub-tank without piston hole exceeds the bend top of the siphon bend pipe of the sub-tank without piston hole, the water in the sub-tank without piston hole flows the float cup by siphon effect.

16. The leak-proof toilet tank according to claim 15, wherein, the end of the siphon tube of the siphon tube includes a plug through hole, a plurality of drain ribs are correspondingly disposed on a float plug of the plug through hole, a plug surface which is larger than the plug through hole is disposed on the top of the drain rib, the plug surface is connected to a sliding section of the drain rib, and a hook is disposed on the end of the sliding section of the drain rib, so that the sliding section of the drain rib slides in the plug through hole, and opens or closes the plug through hole by the plug surface and the space between the drain rib and the plug through hole; wherein, the plug surface is a sealed surface of the float plug, and the float plug is a float object; when the water level is higher than the plug through hole, the float plug floats up and opens the plug through hole.

17. The leak-proof toilet tank according to claim 15, wherein, the end of the siphon tube of the siphon tube is provided with a drain through hole, the drain through hole is disposed on the end of the siphon tube, a float cover is disposed on the drain through hole, the float cover is a floating object and has a pivot end to pivot a pivot pin disposed on the end of the siphon tube, a float cover surface is disposed on the float cover, and opens or closes the drain through the drain through hole by the float cover surface and the pivot end and the pivot pin; wherein, the float cover surface is a sealed surface of the float cover, when the water level is higher than the drain through hole, the float cover floats up and opens the drain through hole.

18. The leak-proof toilet tank according to claim 4, wherein, the end of the siphon tube of the siphon tube includes a plug through hole, a plurality of drain ribs are correspondingly disposed on a float plug of the plug through hole, a plug surface which is larger than the plug through hole is disposed on the top of the drain rib, the plug surface is connected to a sliding section of the drain rib, and a hook is disposed on the end of the sliding section of the drain rib, so that the sliding section of the drain rib slides in the plug through hole, and opens or closes the plug through hole by the plug surface and the space between the drain rib and the plug through hole; wherein, the plug surface is a sealed surface of the float plug, and the float plug is a float object; when the water level is higher than the plug through hole, the float plug floats up and opens the plug through hole.

19. The leak-proof toilet tank according to claim 4, wherein, the end of the siphon tube of the siphon tube is provided with a drain through hole, the drain through hole is disposed on the end of the siphon tube, a float cover is disposed on the drain through hole, the float cover is a floating object and has a pivot end to pivot a pivot pin disposed on the end of the siphon tube, a float cover surface is disposed on the float cover, and opens or closes the drain through the drain through hole by the float cover surface and the pivot end and the pivot pin; wherein, the float cover surface is a sealed surface of the float cover, when the water level is higher than the drain through hole, the float cover floats up and opens the drain through hole.

* * * * *